United States Patent [19]

Hernandez

[11] 4,293,901

[45] Oct. 6, 1981

[54] REFLECTOR SYSTEM HAVING SHARP LIGHT CUTOFF CHARACTERISTICS

[75] Inventor: Jose A. Hernandez, San Marcos, Tex.

[73] Assignee: Esquire, Inc., New York, N.Y.

[21] Appl. No.: 104,011

[22] Filed: Dec. 17, 1979

[51] Int. Cl.[3] ..... F21V 7/06

[52] U.S. Cl. ..... 362/346; 362/297; 362/307; 362/348; 362/804

[58] Field of Search ..... 362/348, 346, 297, 303, 362/804

[56] References Cited

U.S. PATENT DOCUMENTS

| | | | |
|---|---|---|---|
| 3,040,994 | 6/1962 | Anderson et al. | 362/346 |
| 3,529,148 | 9/1970 | Stefano et al. | 362/346 |
| 3,701,898 | 10/1972 | McNamara | 362/346 |
| 4,143,412 | 3/1979 | Sassmannshausen | 362/346 |
| 4,218,727 | 8/1980 | Shemitz et al. | 362/346 |

FOREIGN PATENT DOCUMENTS

| | | | |
|---|---|---|---|
| 1031310 | 5/1978 | Canada | 362/346 |

*Primary Examiner*—Edward A. Miller
*Assistant Examiner*—Irwin Gluck
*Attorney, Agent, or Firm*—Frank S. Vaden, III; Emil J. Bednar; G. Byron Jamison, II

[57] ABSTRACT

A light fixture comprising parabolic reflector segments therein, the lamp being located at the focal point of the segments. One segment has an arc preferably more shallow than the other segment. The window opening is angled preferably at an angle of 60 degrees to the elongate axis of the parabolic segments to provide sharper light cutoff or less spill light from one reflector segment than from the other. A shield positioned parallel to the elongate axis and on the side of the axis within the reflector segment where the cutoff characteristics are the greatest, permits primary reflected light from the lamp, while preventing direct light from the lamp to pass above the shield. The specular underside of the shield enhances light reflection therefrom while the darkened top shield surface blocks secondary reflection above the cutoff angle.

12 Claims, 2 Drawing Figures

REFLECTOR SYSTEM HAVING SHARP LIGHT CUTOFF CHARACTERISTICS

BACKGROUND OF THE INVENTION

1. Field of the Invention

This invention relates to lighting fixtures and more specifically to lighting fixtures including a reflector having sharp cutoff characteristics.

2. Description of the Prior Art

Lighting fixtures housing a high intensity gaseous discharge (HID) lamp of appreciable wattage (e.g., 1000 watts) are used in a wide variety of applications. Many of these applications are situations where the light from the fixture spreads and provides general illumination over a wide area.

For example, a fixture in the middle of a parking lot may conveniently project light downwardly equally over a 360-degree area. By contrast, however, it readily may be recognized that it is desirable to provide light from a fixture near the edge of the lot adjoining a building having windows downwardly and outwardly over only a 180-degree area. It is desirable that light from a corner-located fixture be directed downwardly over only a 90-degree area. And, in all of the applications referred to above, it is undesirable to project light vertically above an angle that would be a nuisance from a location across the street.

Therefore, it is common to design light fixtures or luminaires of various configurations to cut off light from projecting or emanating from such fixtures beyond a certain angle or angles. But, it may be recognized that beyond the designed cutoff angle, not all of the light is cut off, only a high percentage of such light. A luminaire light distribution is designated as being cut off in accordance with IES standards when the candlepower per 1000 lamp lumens does not numerically exceed 25 (2.5%) at an angle of 90 degrees above nadir (horizontal) or 100 (10%) at a vertical angle of 80 degrees above nadir.

One popular design of luminaire used to achieve a high degree of lateral and a certain degree of vertical cutoff is an asymmetrical fixture. In such a fixture the lamp reflector usually includes side reflectors substantially parallel to the aiming axis for cutting off lateral reflections. The curvature of the remaining reflector (i.e., rearward to the lamp bulb) is then at a large arcuate angle with respect to the aiming axis on one side when compared to the arcuate angle on the other side, providing a wider opening on the first side than on the second side. Whether a light fixture which is asymmetrical can be characterized by a discussion to the standard cutoff terminology mentioned above, or with respect to aiming angles, the terminology that is common in a discussion of floodlight characteristics, it is recognized that the sharpness of cutoff on an asymmetrical fixture can be very important.

One of the reflector shapes most favored for a sharp cutoff reflector is the parabolic shape. This is because the light from the focal point of such a reflector is reflected outwardly from the reflector surface parallel to the aiming axis, which is also the long axis of the reflector parabola. A wider than parabolic arcuate spread would project a wider light dispersion and a narrower than parabolic arcuate reflector spread would cause cross light reflections, also resulting in a wider light dispersion. Most prior art asymmetrical fixtures generally have one side which is parabolic but one side which is not, the rear reflectors blending into a continuous curve. Hence, light from at least one portion of the rearward reflector is not parallel to the elongate fixture axis.

Louvers and other light restrictions have also been employed in the prior art to provide means for limiting the amount of light in one or more directions while permitting light to emanate in one or more other directions. Such louvers, however, also sharply decrease the overall efficiency of light production. Another technique for similarly restricting light is the darkening of certain reflective surfaces when compared to the specular treatment of other surfaces. Obviously, such treatment also decreases light efficiency.

It is therefore a feature of the present invention to provide an improved, highly efficient asymmetrical lamp fixture including a parabolic reflector segment that has an extremely sharp light cutoff in one direction.

It is another feature of the present invention to provide an improved, highly efficient asymmetrical lamp fixture having a shield located to enhance cutoff without impairing efficiency, as in the case with prior art louvers.

It is yet another feature of the present invention to provide an improved, highly efficient asymmetrical lamp fixture including a window opening at an angle to the elongate axis of the fixture to improve the direction of reflector light but at a sufficiently large angle with respect to the elongate axis so as not to appreciably degrade or impair the light emanating from the fixture.

SUMMARY OF THE INVENTION

A preferred embodiment of the invention includes, in a reflector system included in an asymmetrical light fixture, a top and rearward parabolic reflector segment for providing a narrow beam above the elongate axis of the reflector and a bottom and rearward parabolic reflector segment for providing a wider beam below the elongate axis of the reflector. The lamp of the fixture is located at the concentric focal points of these parabolic reflector segments. A shield parallel to the elongate axis is located above such axis and is positioned so that its window-terminating end is only slightly above such axis, preferably at a location point just 10 degrees thereabove. The rearward end of the shield blocks the lamp bulb from emanating from the fixture without reflection, but does not block the rear part of the lamp from primary reflection from the top and rearward segment. The underneath side of the shield is made reflective to enhance the overall light from the lower part of the fixture. The window is angled preferably 60 degrees to the elongate axis to further restrict light from the top portion of the reflector more than from the bottom portion, while still not appreciably impairing, by internal reflection, light that emanates through the window.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the appended drawings illustrate only typical embodiments of the invention and are therefore not to be considered limiting of its scope, for the invention may admit to other equally effective embodiments.

In the drawings.

DESCRIPTION OF THE PREFERRED EMBODIMENT

Figure 1:
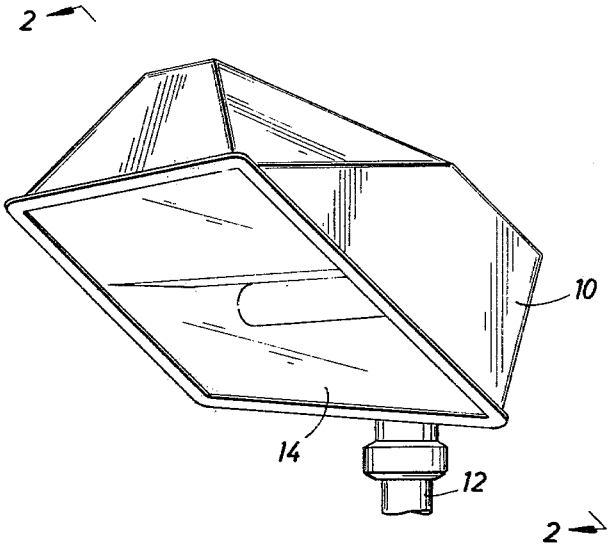
FIG. 1 is an oblique pictorial of a preferred embodiment of a light fixture in accordance with the present invention.

Now referring to the drawings, and first to FIG. 1, a preferred embodiment of a lighting fixture shown in its housing, in accordance with the present invention, is illustrated in an oblique pictorial. Housing 10 is shown conveniently mounted to a supporting structure in the form of a post. Window opening 14 is angled downwardly in a manner more fully described hereinafter so as to provide illumination from the fixture in a downwardly and outwardly direction. The window can be glass or a plastic film having good transmittance properties.

Figure 2:
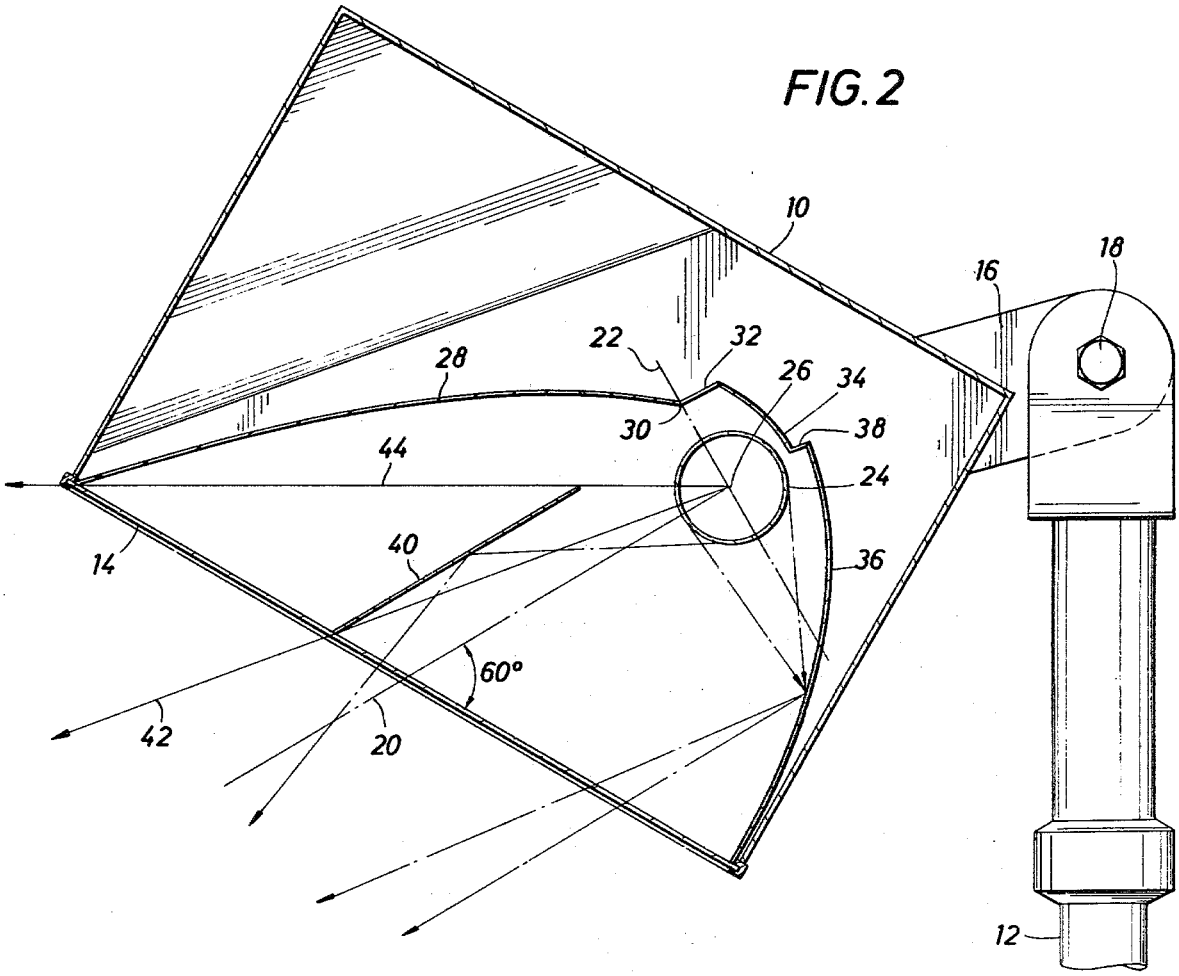
FIG. 2 is a cross sectional view of the reflector system included in the light fixture shown in FIG. 1, the section being taken at line 2—2.

FIG. 2 is a cross sectional view of the lighting fixture, showing the relationships of the internal light fixture system. Also shown is the structure for mounting housing 10 to post 12. The upper end of the post is conveniently bifurcated for receiving a mounting flange 16 therein, flange 16 being fixedly secured to housing 10. A bolt-and-nut arrangement 18 through appropriate receiving holes in the flange and the bifurcated end of the post provides means for securing housing 10 in its desired attitude or position.

Now referring to the reflector system shown in FIG. 2, a preferred embodiment of such arrangement in accordance with the present invention is illustrated. The elongate axis 20, although not positioned horizontally since the housing is angled forward as hereinafter described, is sometimes referred to in describing the geometric relationships of the fixture as "horizontal". Likewise, axis 22, the complementary Cartesian axis coordinated with axis 20, is sometimes referred to in the geometric discussion which follows as the "vertical" axis, although, in truth, it is not vertical, as hereinafter explained.

Lamp 24 is located within the fixture with its center at focal point of the reflector segments hereinafter described, which focal point coincides with the crossing intersection of axes 20 and 22. Lamp 26 is typically an elongated gaseous-filled lamp held in position by its socket or sockets (not shown) so that its elongate axis is at right angles to the plane of the drawing at point 26. A suitable holding arrangement for a lamp is illustrated in patent application Ser. No. 021,269, filed Mar. 15, 1979, by the same inventor and commonly assigned, which disclosure is fully incorporated herein by reference for all purposes. The particular bulbous configuration of lamp 24 is not important to the invention; however, a lamp having a relatively constant diameter for a significant dimensional length is illustrated for ease of understanding in the discussion that follows. Therefore, for such purpose, lamp 24 can be assumed to have a substantially uniform diameter, as shown.

In order to cope with the problem of achieving a sharp cut-off from a substantially tubular source, a family of curves having the reflecting properties shown in FIG. 2 have been developed. The ray from the surface of the tube nearest the reflector results in a reflected ray from the surface of the reflector which is parallel to the axis. The parametric equation for defining such a family of curves are:

$$y=\tfrac{1}{2}[x(p-1/p)-a(p+1/p)],$$

$$x=p(c-2a\phi)-a,$$

where a is the radius of the tube; $p=dy/dx=\tan\phi$; and $c=-2y$, when $x=-a$. In the formula y is the elongate axis and x is the orthogonal axis therewith. The center of the tube is located at the x,y crossing, which is also the focal point for the curves.

The shape of the reflector defined by such equations is approximately parabolic. Note that a true parabolic fixture would reflect parallal rays from a point source of light, whereas the fixture above corrects for this bulb dimension insofar as it reflects parallel rays from the most rearward bulb surface. For purposes herein, however, the term parabolic will be used to include not only truly parabolic or substantially parabolic shaped curves, but also curves defined by the above equations.

Hence, as discussed above, top reflector segment 28 of the reflector system is parabolically shaped with its focal point at point 26 and has a rather narrow opening. That is, the end of reflector segment 28 at window 14 has already asymptotically reached a position approaching a parallel line to elongate axis 20. With respect to the equations set out above for the preferred shape of the reflector segments, a preferred embodiment of the present invention includes a top reflector segment 28 having a value c equal to 2.9. The rearward end of segment 28 terminates slightly behind the front part of lamp 24 with respect to a line drawn therethrough parallel with window 14.

The slope of segment 28 is so shallow that if it were extended to its vertex, the segment would interfere with the envelope of lamp 24. Therefore, at a position 30, where the vertical axis intersects the arc of reflector 28, a short reflector segment 32 parallel to the horizontal axis, is connected. Such connection assures that parabolic rearward reflector segment 34, connected to the other end of reflector segment 32, is spaced apart from the surface of lamp 24. A preferred value a for parabolic reflector sgement 34 is 4.

Bottom reflector segment 36 is also parabolically shaped, having a preferred value c of 4.6. Hence, it may be seen that the slope of this segment is not nearly as steep as for the top segment. Moreover, the vertex position is even further removed from lamp 24 than reflector 34 is from lamp 24, thereby necessitating a connecting piece 38 between segments 34 and 36 along axis 20.

Window 14 is located along axis 20 at a distance to provide the beam width desired from the reflector. However, the window is not at right angles with axis 20, as with most luminaires, even asymmetrical ones, but instead is at an angle of about 60 degrees to axis 20. Such a window location has several beneficial advantages.

First, it shortens the length of bottom reflector segment 36 with respect to top reflector segment 28. This means that cutoff in the downward direction is approximately back toward pole 12 with the reflector angled as shown. This may be seen by considering the direction of the light ray emanating from the front surface of lamp 24 as it passes by the front corner or exit pupil of the fixture at the window edge of reflector segment 36.

Primary reflected light from center 26 of lamp 24 is reflected forward from reflector segment 36 parallel to axis 20, an important characteristic of a parabolic reflector. However, the light "cone" from the surfaces of lamp 24 results in a primary reflected light spread. Direct light just past the exit pupil edge of the fixture is almost straight down from the fixture as shown in the drawing, with all other direct and primary reflective light emanations being in front of such downward emanation.

The second advantage of window 14 being angled the way it is is that the length of reflector segment 28 is longer than the length of reflector segment 36, thereby advantageously reducing the cutoff angle of segment 28 even beyond that caused by the difference in the respective parabolic arc slopes of the reflector segments.

The third advantage of window 14 being at only about 60 degrees to axis 20 is that the light transmittance through the lens is not greatly impaired compared with a lens positioned at a right angle to axis 20. That is, the light reflected back into the fixture from the 60-degree lens is not very great, as it would be with a more sharply angled lens.

The position and length of shield 40 is determined as follows. A line 42 is drawn from focal point 26 at an angle approximately 10 degrees above horizontal axis 20. The front end of shield 40 is placed at the point that line 42 intersects the plane of window 14. Shield 40 is parallel to axis 20. Another line 44 is drawn from focal point 26 to the window end of reflector segment 28. The rear end of shield 40 is determined by the intersection of shield 40 with line 44.

Such a location of the shield blocks all direct light from lamp 24 above line 42. All primary reflected light from the rearward portion of lamp 24 is permitted to be reflected from reflector segment 28. Hence, the spill light is greatly reduced, thereby sharpening the cutoff characteristics.

The top surface of the shield is darkened by any convenient means, such as by painting with black paint. The underneath side is made specular, as with the other reflective surfaces, so that secondary reflections from the top shield surface are greatly reduced and primary reflections from the bottom surface increase the efficiency of the downwardly directed light. Hence, the shield blocks non-useful light rays and redirects other rays more usefully.

Obviously, shield 40 can be located at a different angle than 10 degrees, in the 5–40 degree range, but a 10-degree angle has proven extremely satisfactory in actual practical designs of the invention. Of course, a differently located shield would have a different length than a 10-degree located shield.

The above design permits sharp cutoff from a fixture of relatively limited dimension never before achieved and can be thought of as an extremely useful technique of "miniaturizing" so as to attain equal results otherwise achievable only with fixtures of much larger dimension (e.g., having shallow parabolic reflectors of great length). Not only is there a material savings, but the efficiency of such a fixture is extremely high.

While a particular embodiment of the invention has been shown and described, it will be understood that the invention is not limited thereto since many modifications may be made and will become apparent to those skilled in the art. For example, three parabolic segments are shown. The number can be reduced to two or even one and still be within the scope of the broad concept of the invention.

What is claimed is:

1. A sharp cutoff reflector including a plurality of parabolic segments and housing a lamp therein so that its center is at the concentric focal point of the parabolic segments of the reflector, comprising a top parabolic reflector segment having a narrow beam reflective surface, a bottom parabolic reflector segment having a narrow beam reflective surface, said top and bottom parabolic reflectors terminating in a window opening plane approximately 60 degrees to the parabolic elongate axis, a reflective shield above and parallel with the elongate axis, the window end thereof being at a position in the range of approximately 5–40 degrees to the horizontal with respect to the focal points, the rearward end thereof being on a line between the focal points and the exit pupil of the window opening at said top reflector segment.

2. A sharp cutoff reflector in accordance with claim 1, wherein the window end of said reflective shield is at a position of about 10 degrees to the horizontal with respect to the focal points.

3. A sharp cutoff reflector in accordance with claim 1, wherein said bottom parabolic reflector segment is less narrow than said top parabolic reflector segment.

4. A sharp cutoff reflector in accordance with claim 1, wherein the beam from the focal points to the end of said shield determines the top cutoff limit of the reflector and the spill characteristics of the lamp and said bottom reflector segment determines the bottom cutoff limit of the reflector.

5. A sharp cutoff reflector in accordance with claim 1, and including a window in said window opening plane.

6. A sharp cutoff reflector in accordance with claim 1, wherein the top surface of said reflective shield is darkened and the bottom surface of said shield is reflective.

7. A sharp cutoff reflector including at least one parabolic segment and housing a lamp therein so that its center is at the focal point of the parabolic segment, comprising a window in a plane approximately 60 degrees to the parabolic elongate axis of the parabolic segment and intercepting the segment, and a reflective shield between the parabolic elongate axis and the reflector segment and parallel with the axis, the window end of said shield being at a position in the range of approximately 5–40 degrees to the horizontal with respect to the focal point, the rearward end thereof being on a line between the focal point and the exit pupil of the window at said reflector segment.

8. A sharp cutoff reflector in accordance with claim 7, wherein the window end of said reflective shield is at a position of about 10 degrees to the horizontal with respect to the focal point.

9. A sharp cutoff reflector in accordance with claim 7, wherein the top surface of said reflective shield is darkened and the bottom surface of said shield is reflective.

10. A sharp cutoff reflector in accordance with claim 1, wherein said parabolic reflector segments are defined by the following parametric equations:

$$y=\tfrac{1}{2}[x(p-1/p)-a(p+1/p)],$$

$$x=p(c-2a\phi)-a,$$

wherein a is the radius of the lamp, $p=dy/dx=\tan\phi$, and $c=-2y$, when $x=-a$.

11. A sharp cutoff reflector in accordance with claim

10, wherein said top reflector segment has a c value equal to 2.9.

12. A sharp cutoff reflector in accordance with claim 10, wherein said bottom reflector segment has a c value equal to 4.6.

* * * * *